US009287060B2

(12) United States Patent
Dedina et al.

(10) Patent No.: US 9,287,060 B2
(45) Date of Patent: Mar. 15, 2016

(54) CONVERSION DEVICE FOR CONVERTING A MECHANICAL POSITION INTO AN ELECTRIC STATE

(71) Applicants: Grégory Dedina, Vourey (FR); Tomáš Kulovaný, Rožmitál pod Třemšínem (CZ)

(72) Inventors: Grégory Dedina, Vourey (FR); Tomáš Kulovaný, Rožmitál pod Třemšínem (CZ)

(73) Assignee: Schneider Electric Industries SAS, Rueil-Malmaison (FR)

( * ) Notice: Subject to any disclaimer, the term of this patent is extended or adjusted under 35 U.S.C. 154(b) by 371 days.

(21) Appl. No.: 13/648,772

(22) Filed: Oct. 10, 2012

(65) Prior Publication Data

US 2013/0087438 A1 Apr. 11, 2013

(30) Foreign Application Priority Data

Oct. 10, 2011 (FR) ..... 11 03079

(51) Int. Cl.

| | |
|---|---|
| ***H01H 3/00*** | (2006.01) |
| ***H01H 1/20*** | (2006.01) |
| ***H01H 50/54*** | (2006.01) |
| ***H01H 71/46*** | (2006.01) |

(52) U.S. Cl.

CPC ..... *H01H 1/20* (2013.01); *H01H 50/541* (2013.01); *H01H 71/46* (2013.01)

(58) Field of Classification Search

CPC ..... H01H 19/10; H01H 21/18; H01H 21/22; H01H 21/24; H01H 21/36; H01H 13/06; H01H 13/10; F21V 23/04; F21S 4/001

USPC ..... 200/18, 553, 335–339, 4

See application file for complete search history.

(56) References Cited

U.S. PATENT DOCUMENTS

| | | | | |
|---|---|---|---|---|
| 4,580,021 | A * | 4/1986 | Fujikake | 200/400 |
| 5,692,044 | A * | 11/1997 | Hughes et al. | 379/422 |
| 6,756,554 | B1 * | 6/2004 | Hu | 200/406 |
| 7,759,587 | B2 * | 7/2010 | Kim et al. | 200/4 |
| 2007/0074961 | A1 * | 4/2007 | Chiu | 200/18 |

FOREIGN PATENT DOCUMENTS

| | | |
|---|---|---|
| DE | 20 2005 015 448 U1 | 12/2005 |
| EP | 1 148 529 A1 | 10/2001 |
| FR | 2 617 331 A1 | 12/1988 |
| FR | 2 916 899 A1 | 12/2008 |

* cited by examiner

*Primary Examiner* — Briggitte R Hammond
*Assistant Examiner* — Lheiren Mae A Caroc
(74) *Attorney, Agent, or Firm* — Steptoe & Johnson LLP

(57) ABSTRACT

In this device, a mechanism for receiving an input mechanical command and for actuating first and second switches comprises a lever having a first side arm tiltable about a swiveling axis of said lever and a second side arm tiltable about the same swiveling axis. The first side arm and the second side arm are respectively arranged on a first side and a second side opposite relative to said swiveling axis. The first side arm is an operating arm for operating the first switch. The second side arm is an operating arm for operating the second switch.

16 Claims, 4 Drawing Sheets

CONVERSION DEVICE FOR CONVERTING A MECHANICAL POSITION INTO AN ELECTRIC STATE

TECHNICAL FIELD OF THE INVENTION

The invention relates to a conversion device for converting a mechanical position into an electric state, of the type comprising:

a first switch actionable between open and closed states, a second switch actionable between open and closed states, and a mechanism for receiving an input mechanical command and for actuating first and second switches according to this input command.

STATE OF THE ART

In the French patent application FR-2 916 899, it is described a signaling auxiliary one conversion device of which, placed in an envelope, is of the above-mentioned type. In this conversion device, both switches are double contact switches and the mechanism for actuating them comprises a flap which is intended to tilt and then actuate, when moving, the mobile contact-holder of the switches. Each mobile contact-holder is returned by a leaf spring towards one of its two positions: open and closed. A fork is moreover engaged with a crank of the flap so as to be able to make said flap tilt. It is provided on one of the two arms of a rocking lever whose swiveling axis is orthogonal to the tiltable axis of the flap and the mobile contact-holders.

The conversion device mentioned in the preceding paragraph is complex. Its complexity is explained, at least partially, by the need for meeting various requirements, such as requirements resulting from interactions with external devices arranged according to a given space organization and such as constraints resulting from the installation of the conversion device into a reduced space having set dimensions. In this respect, the choice of double-contact switches depends on the need for compact overall dimensions.

SUMMARY OF THE INVENTION

At least one object of the invention is to propose a conversion device which is of the above-mentioned type and which is simpler while meeting one or more specific space constraints.

At least this object is achieved thanks to a conversion device which is of the above-mentioned type and whose mechanism comprises a lever having a first side arm tiltable, i.e. able to title, about a swiveling axis of this lever and a second side arm tiltable about the same swiveling axis. The first side arm and the second side arm are arranged respectively on a first side and a second side opposite each other relative to said swiveling axis. The first side arm is an operating arm for operating the first switch, which is on the first side relative to said swiveling axis. The second side arm is an operating arm for operating the second switch, which is on the second side. This second side is opposite the first side, relative to said swiveling axis.

The conversion device according to the invention can embody one or more other advantageous features, separately or in combination, in particular among those defined below.

Advantageously, each of the first and second switches comprises:

a fixed contact, a mobile contact mobile at least between an open position, in which this mobile contact is at a distance from the fixed contact, and a closed position, in which the mobile contact and the fixed contact meet and establish an electric connection, and a controllable support which bears the mobile contact and is controllable between a configuration in which said mobile contact is set in the open position and a configuration in which said mobile contact is set in the closed position.

Preferably, the first side arm is an operating arm for operating the controllable support of the first switch, while the second side arm is an operating arm for operating the controllable support of the second switch.

Advantageously, at least in the first switch, the controllable support bearing the mobile contact is a conductor for electrically connecting this mobile contact to an electric circuit.

Advantageously, at least the first switch comprises an elastic returning element for returning its mobile contact into one of the open and closed positions of said mobile contact. Preferably, the first side arm is an arm for pushing, against the action of the elastic returning element, on the controllable support of the first switch.

Advantageously, the elastic returning element exerts an elastic return in the closing direction of the first switch. Preferably, the first side arm is tiltable from an active retaining position, towards an intermediate position, up to a passive position. In the active retaining position, the first switch in retained in the open state against the action of the elastic returning element. In the intermediate position, the first switch is closed. The passive position is beyond the intermediate position in the direction of the elastic return. In the passive position, the elastic return generates a calibrated force closing the first switch, without interference of the first side arm.

Advantageously, at least in the first switch, the controllable support bearing the mobile contact forms the elastic returning element for elastically returning this mobile contact.

Advantageously, at least in the first switch, the controllable support bearing the mobile contact comprises an elongated finger one end of which is fixed, which is elastically flexible, at least locally, between the open and closed positions of the mobile contact of the first switch and which bears this mobile contact at a distance from the fixed end.

Advantageously, the elongated finger has the shape of a leaf on one face of which is located the corresponding mobile contact.

Advantageously, the leaf comprises an elastically flexible elbow prolonged by a fixed mounting base located at the fixed end of the finger.

Advantageously, the lever comprises a shaft which extends along said swiveling axis and bears the first and second side arms.

Advantageously, the conversion device comprises a crank an arm of which tiltable around said swiveling axis is rigidly associated with the shaft of the lever and bears a crank pin for receiving the input command, at a distance of said swiveling axis.

BRIEF DESCRIPTION OF THE DRAWINGS

Other advantages and features will more clearly arise from the following description of particular embodiments of the invention given as nonrestrictive examples and represented in the annexed drawings, among which.

DESCRIPTION OF PREFERENTIAL EMBODIMENTS OF THE INVENTION

Figure 1:
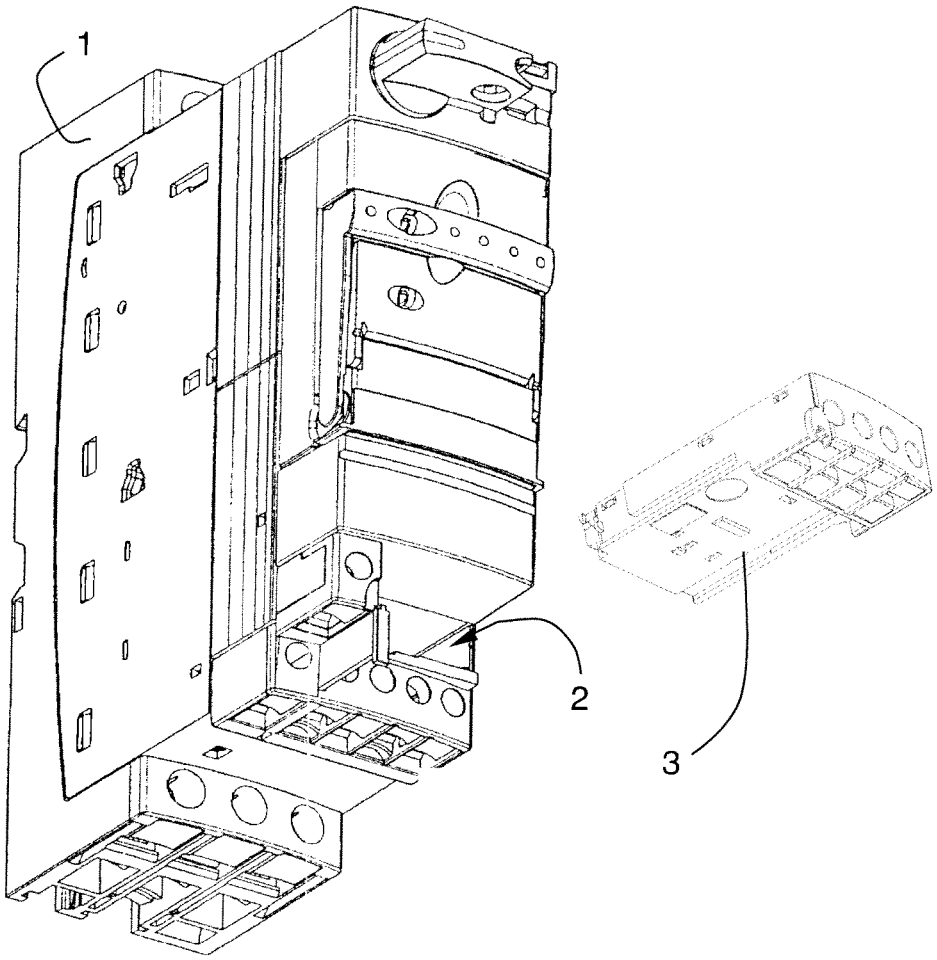
FIG. 1 is a perspective view, partially exploded, of a motor safety device and of a signaling auxiliary equipping this safety device.

FIG. 1 shows a safety device 1, which is intended to be connected to a supply terminal of an electric motor, for protecting said motor, and which includes a circuit breaker, a thermal relay and a contactor in a known per se manner.

A signaling auxiliary 3 can be mounted and connected in a housing 2 in the safety device 1. The function of this signaling auxiliary 3 is to give two different bits of information about the safety device 1, such as whether the contactor of this safety device 1 is in the available state or not and whether the electric protection is in a triggered state or not.

Figure 2:
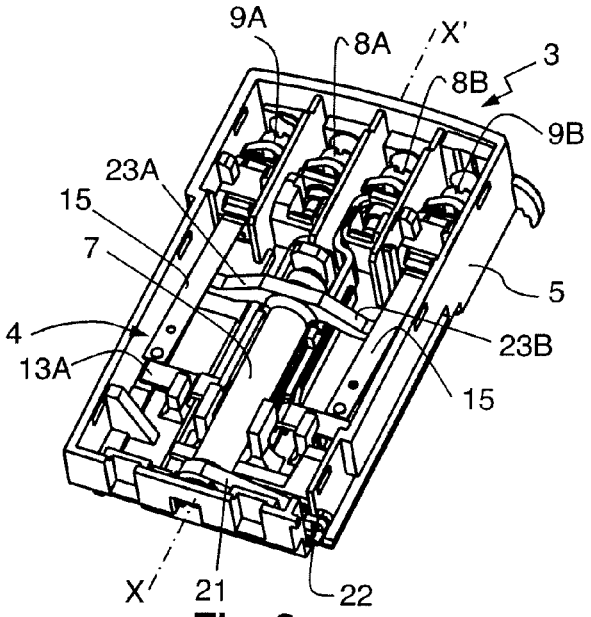
FIG. 2 is a perspective view showing a case for the signaling auxiliary in FIG. 1, without cover, and showing its contents, namely a conversion device for converting a mechanical position into an electric state, according to a first embodiment of the invention.

As it can be seen in FIG. 2, the signaling auxiliary 3 comprises an electromechanical conversion device 4, which is mounted in a case 5 in order to be enclosed therein by means of a cover, not represented for the sake of clarity.

Figure 3:
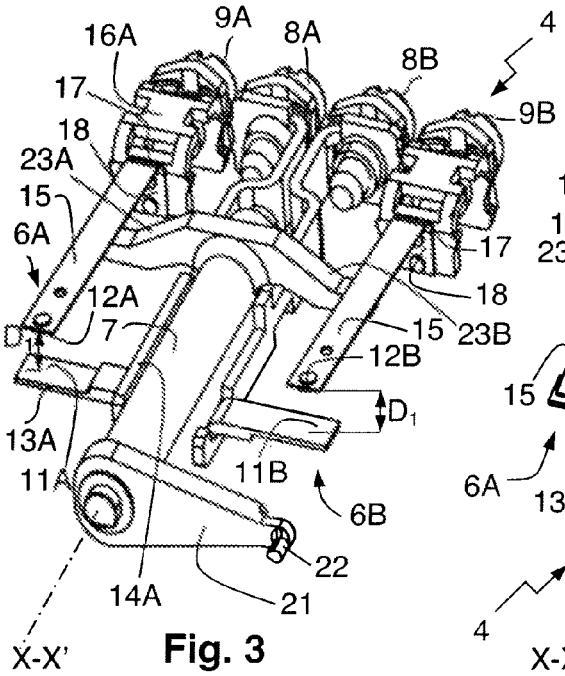
FIG. 3 is a perspective view where only the conversion device in FIG. 2 is represented, without the case for housing it.

The device 4, represented alone in FIG. 3, is according to a first embodiment of the invention. Its function is more precisely to convert a mechanical position into an electric state and it comprises two switches GA and GB intended to be actuated by the same single lever 7, which swivels about an axis X-X'.

Figure 5:
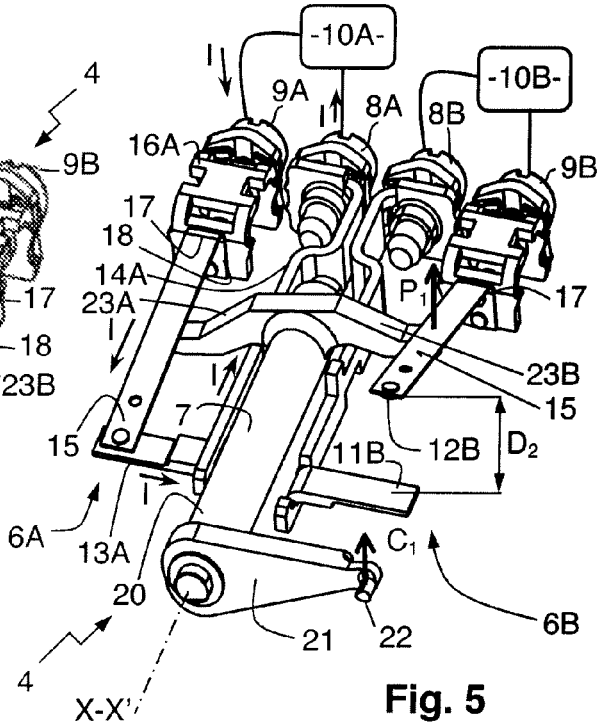
FIG. 5 is a view which is similar to that in FIG. 3 and where the conversion device in FIG. 3 is in a first active state.

A first pair of terminals 8A and 9A is designed to connect the switch 6A into a first electric circuit 10A, which is schematically represented in FIG. 5 and whose function is to transmit one of the two bits of information previously mentioned. A second pair of terminals 8B and 9B is provided to connect the switch 6B into a second electric circuit 10B, which is also represented schematically in FIG. 5 and whose function is to transmit the other bit of information about the state of the circuit breaker 1. The terminals 8A, 9A, 8B and 9B are aligned in a same line, along a rear face of the case 5.

The switch 6A comprises two paired contacts which are intended to establish an electric connection when meeting, namely a fixed contact 11A and a mobile contact 12A mobile at least between two positions, which are an open position of separation and disconnection from the fixed contact 11A and a closed position of contact and connection with this fixed contact. In its open position, the mobile contact 12A is separated and disconnected from the fixed contact 11A. In its closed position, the mobile contact 12A contacts the fixed contact 11A and is connected to the latter. The free end of a fixed arm 13A defines the fixed contact 11A. This fixed arm 13A is part of a conducting element 14A which electrically connects the fixed contact 11A to the terminal 8A.

An electrically conducting metal finger 15 forms a controllable support bearing or carrying the mobile contact 12A, which this finger 15 and a conducting mount 16A electrically connect to the terminal 9A.

The finger 15 has the shape of a leaf or tongue, which comprises an elastically flexible elbow 17 and which a mounting base 18 prolongs beyond this elbow 17. At a fixed end of the controllable finger 15, this base 18 is rivetingly fixed to the mount 16A. The mobile contact 12A is located on a face of the finger 15, at a distance from the elastically flexible elbow 17 and at a mobile end of this finger 15. The elbow 17 tends to return the finger 15 towards the fixed arm 13A, into a closed position of the switch 6A.

The switch 6B has the same conformation as the switch GA, while being substantially symmetrical to the latter relative to a plane passing through the swiveling axis X-X'. Its fixed contact 11B and its mobile contact 12B are electrically connected to the terminal 8B and the terminal 9B, respectively. The support of the mobile contact 12B is another controllable finger 15. The piece forming the finger 15 of the switch 6A and that forming the finger 15 of the switch 6B are identical and are mounted in the same way.

Figure 4:
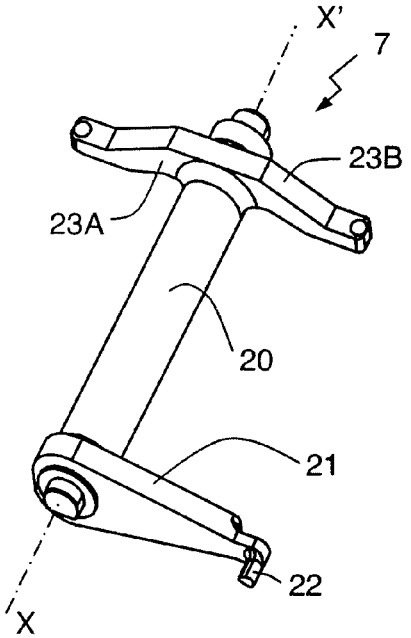
FIG. 4 is a perspective view of a lever, which is a component of the conversion device in FIG. 3.

The lever 7, molded from an insulating material, is a monobloc piece, which is represented alone in FIG. 4. The lever 7 comprises a shaft 20, which extends along the swiveling axis X-X' and each of the two ends of which is retained in a smooth bearing of the case 5 so as to swivel therein. The shaft 20 is provided with a crank 21 which is intended to control said shaft according to an input command received by the crank pin 22 of this crank 21.

The shaft 20, arranged between the switches 6A and 6B, bears and associates rigidly two tiltable side arms, which extend opposite to each other, in two opposite directions, and which are an operating arm 23A for operating the switch 6A and an operating arm 23B for operating the switch GB.

In FIG. 3, the crank 21 is in a neutral intermediate position having no meaning, when the signaling auxiliary is not in function. The fixed contact 11A and the mobile contact 12A are separated from each other by a distance $D_1$. The same substantially goes for the fixed contact 11B and the mobile contact 12B. The distance $D_1$ is lower than the minimal insulation distance that must be respected to avoid the occurrence of an arc when the circuits 10A and 10B are powered.

Figure 6:
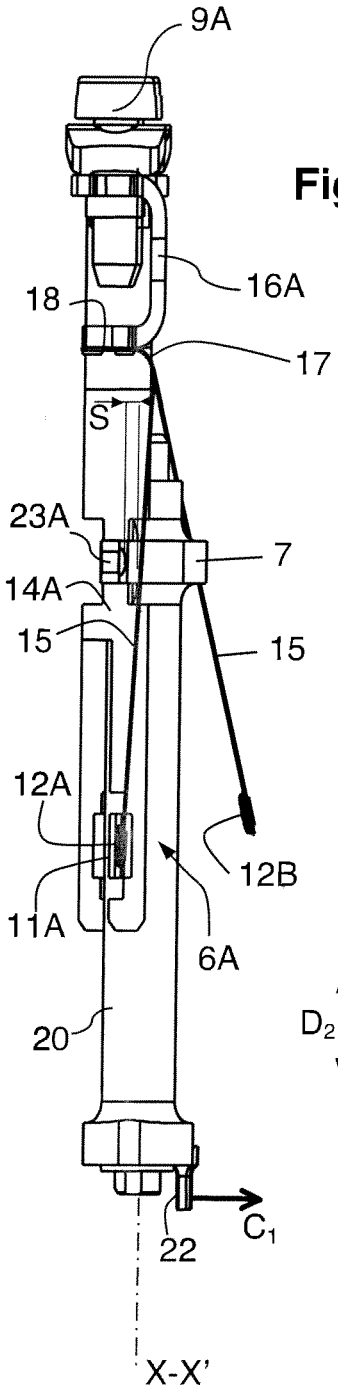
FIG. 6 is a side view where the conversion device in FIG. 3 is in the same first active state as in FIG. 5.

In FIGS. 5 and 6, the crank 21 has been tilted into a first position, in which it is maintained because of an input command in the form of a constant action $C_1$ on its crank pin 22. The tilting of this crank 21 has led to a tilting of the operating arms 23A and 23B in the same direction about the axis X-X'. During this, the operating arm 23A has let the switch 6A close by itself, under the effect of the elastic return force generated by the leaf defining the elbow 17 and the finger 15 of this switch 6A. In the same time, the operating arm 23B has pushed the finger 15 of the other switch 6B, in the direction opposite the fixed contact 11B, against the elastic return force generated by the leaf defining the elbow 17 and the finger 15 of this switch 6B.

In FIG. 5, the operating arm 23B exerts a thrust $P_1$ on the finger 15 of the switch 6B. The fixed contact 11B and the mobile contact 122 are separated from each other by a distance $D_2$ higher than the distance $D_1$ and at least equal to the minimal insulation distance which must be respected to avoid the occurrence of an arc when the circuit 102 is powered. The definition of this minimal insulation distance is the subject of the standards EN/CEI 60947-6-2, EN/CEI 60947-5-1, EN/CEI 60068-2-6, EN/CEI 60721-4-2, EN/CEI 60947-5-4 and UL 508.

Still in FIG. 5, the switch 6A is closed. As it can be seen in FIG. 6, the operating arm 23A does not then act anymore on the finger 15 of this switch, by being at a separating distance S from it. Thereby, this finger 15 is only subjected to the elastic return acting in the closing direction of the switch 6A. This elastic return then exerts a calibrated force pressing the mobile contact 12B on the fixed contact 11B, i.e. what is usually called "contact effort", which is advantageous. The current circulating through the closed circuit 10A is symbolized by the arrows I. It can circulate in the direction indicated by these arrows I or in the opposite direction.

Figure 7:
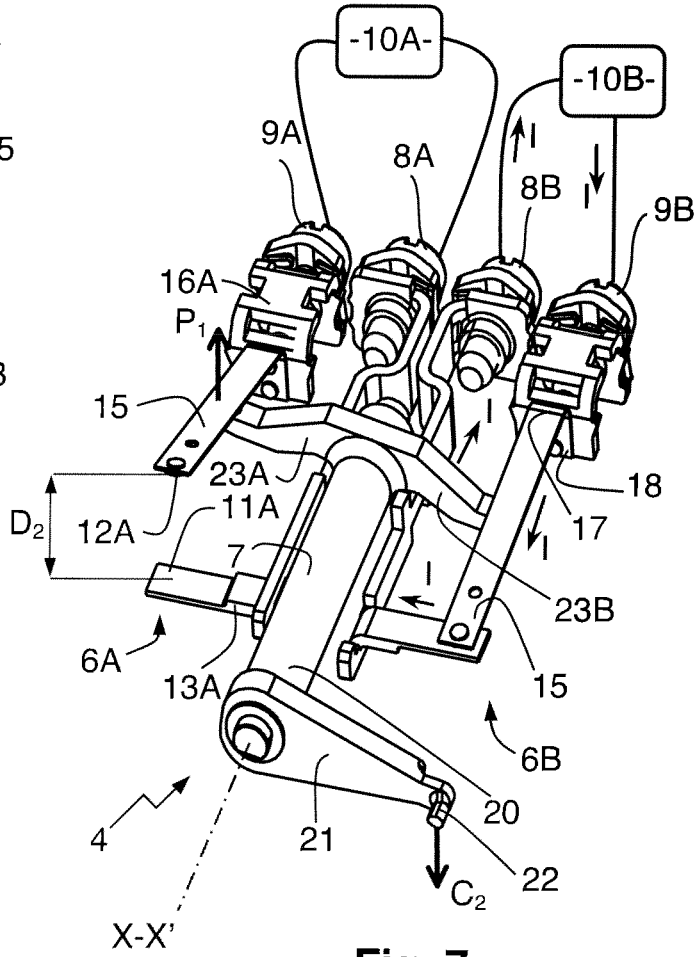
FIG. 7 is a view which is similar to that in FIG. 3 and where the conversion device in FIG. 3 is in a second active state.

In FIG. 7, the crank 21 has been tilted into a second position, in which it is maintained because of an input command in the form of a constant action $C_2$ on its crank pin 22. The operating arm 23A exerts the thrust $P_1$ on the finger 15 of the switch 6A. The fixed contact 11A and the mobile contact 12A are separated from each other by the distance $D_2$, i.e. by a distance higher than or equal to the above-mentioned minimal insulating distance. Whereas the switch 6A is thus open, the switch 6B is closed. The operating arm 23B is at a distance from the corresponding finger 15. The elastic return generated by the leaf defining the elbow 17 and the finger 15 of the switch 6B then exerts a calibrated force clamping the mobile contact 12B on the fixed contact 11B. The current circulating through the closed circuit 10E is symbolized by the arrows I. It can circulate in the direction indicated by these arrows I or in the opposite direction.

Figure 8:
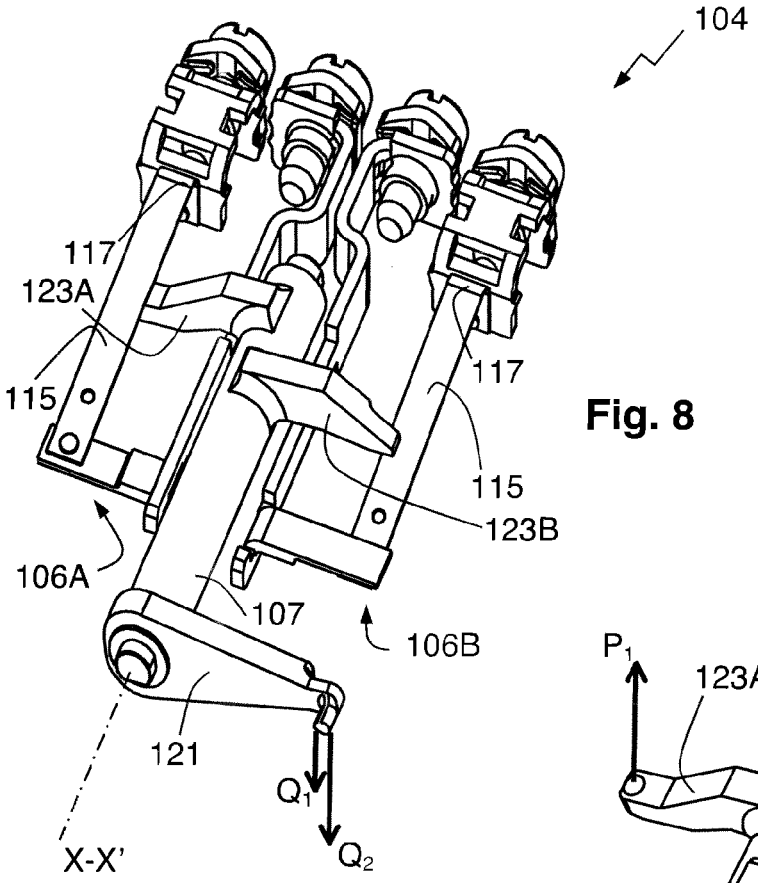
FIG. 8 is a view which is similar to that in FIG. 3 and which shows a conversion device according to a second embodiment of the invention.

A conversion device 104 according to a second embodiment of the invention is represented in FIG. 8. Below, it is only described what distinguishes the conversion device 104 from the device 4. Moreover, a reference used hereafter for indicating a part of the device 104 analog or equivalent to a referred part of the device 4 is obtained by adding one hundred to the reference identifying this part in the device 4.

Figure 9:
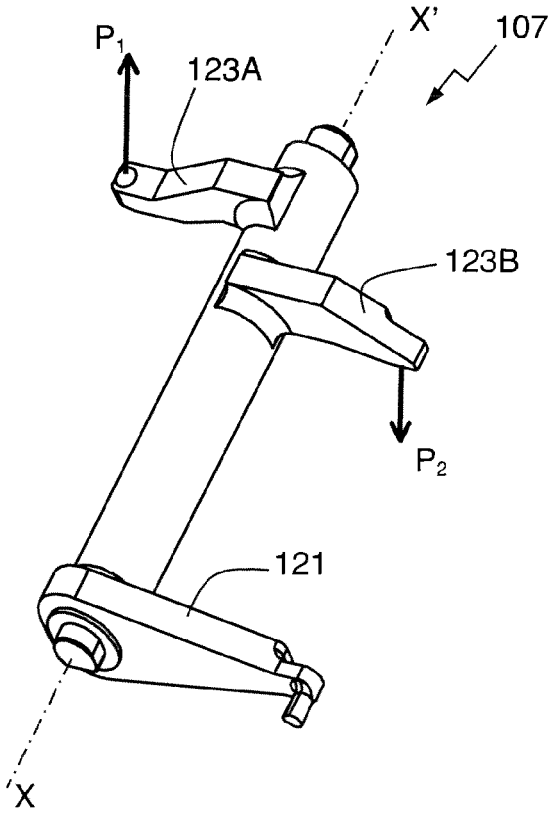
FIG. 9 is a perspective view of a lever which is a component of the conversion device in FIG. 8.

The switch 106B is generally inverse so that it is closed due to a displacement in a direction opposite that of the displacement toward closing the switch 6B. The elastically flexible elbow 117 of the switch 106B and the elastically flexible elbow 17 of the switch 6B exert elastic returns in opposite directions. As it can be seen in FIG. 9, the operating arm 123B of the lever 107 is oriented so as to exert a thrust $P_2$ in the direction opposite that of the thrust $P_1$. This operating arm 123B is moreover axially shifted towards the fixed and mobile contacts, relative to the operating arm 123A.

In FIG. 8, both switches 106A and 106B are maintained closed by the elastic returns generated within each of them, by the leafs forming the elbows 117 and the fingers 115, when the operating arms 123A and 123B are inactive.

When the crank 121 is tilted by a quantity $Q_1$, the operating arm 123A exerts a thrust on the finger 115 of the switch 106A and thus maintains the latter open, while the operating arm 123B remains inactive and the switch 106B is maintained closed.

When the crank 121 is tilted by a quantity $Q_2$ higher than the quantity $Q_1$, the operating arms 123A and 123B maintain both switches 106A and 106B open, by pushing back their respective fingers 115.

It will be noted that the insulating distances such as the distance $D_2$, as well as several efforts related to the switch controls can be easily determined by suitably choosing the positions of the operating arms 23A, 23B, 123A and 123B along to the swiveling axis X-X', which is advantageous.

The invention claimed is:

1. A mechanically operated electrical switch device, comprising:

a first electric switch actionable between open and closed states, a second electric switch actionable between open and closed states, a shaft rotatable about its longitudinal axis, a first side arm extending substantially radially from said shaft, for operating the first switch, a second side arm extending substantially radially from said shaft, for operating the second switch, the first side arm and the second side arm, respectively, extending from a first side and an opposite second side of said shaft, the first switch being on the first side of said axis, the second switch being on the second side of said axis, and each of the first and second switches comprises:

a fixed contact, a mobile contact mobile between an open state in which this mobile contact is at a distance from the fixed contact, and a closed state in which the mobile contact and the fixed contact meet to thereby establish an electrical connection, and a controllable support for the mobile contact, which support is a conductor for electrically connecting the mobile contact to an electric circuit and is controllable between a position in which said mobile contact is in the open state and a position in which said mobile contact is in the closed state, the first side arm being positioned for operating the controllable support of the first switch, and the second side arm being positioned for operating the controllable support of the second switch.

2. The switch device according to claim 1, wherein at least the first switch comprises an elastic element for returning the mobile contact into one of the open and closed states, the first side arm for pushing the controllable support of the first switch against the force of the elastic element.

3. The switch device according to claim 2, wherein the elastic element exerts an elastic return force in a closing direction of the first switch, the first side arm being tiltable about said axis from an active retaining position in which the first switch is retained in the open state against the force of the elastic returning element in a direction towards an intermediate position in which the first switch is in the closed state, and to a passive position which is beyond the intermediate position in said direction in which passive position the elastic element generates a calibrated force for closing the first switch, without interference of the first side arm.

4. The switch device according to claim 2, wherein, in the first switch, the controllable support bearing the mobile contact forms the elastic element for elastically returning said mobile contact.

5. The switch device according to claim 4, wherein, in the first switch, the controllable support for the mobile contact comprises an elongated finger one end of which is fixed, and which is elastically flexible, between the open and closed states of the mobile contact of the first switch and wherein the mobile contact is at a distance from the fixed end of said finger.

6. The switch device according to claim 5, wherein the elongated finger has thin thickness between two opposite faces, with a mobile contact located on one of said faces.

7. The switch device according to claim 6, wherein the finger includes an elastically flexible elbow at the fixed end of the elongated finger.

8. The switch device according to claim 1, further comprising a crank rigidly connected to the shaft and bearing a crank pin at a radial distance from said axis.

9. A mechanically operated electrical switch device, a first electric switch actionable between open and closed states, a second electric switch actionable between open and closed states, a shaft rotatable about its longitudinal axis, a first side arm extending substantially radially from said shaft, for operating the first switch, a second side arm extending substantially radially from said shaft, for operating the second switch, the first side arm and the second side arm, respectively, extending from a first side and an opposite second side of said shaft, the first switch being on the first side of said axis, the second switch being on the second side of said axis, and each of the first and second switches comprises a finger for movement in a direction in a plane which is substantially parallel to a plane which includes the axis of the shaft, for thereby actuating said switches between their open and closed states, the first side arm is positioned for contacting the finger of the first switch and displacing the finger of the first switch when the shaft is rotated in a first rotary direction thereby actuating the first switch, and the second side arm is positioned for contacting the finger of the second switch when the shaft is rotated in a second opposite rotary direction thereby actuating the second switch, and wherein each switch additionally comprises:

a fixed contact, a mobile contact located on the finger for movement between an open state in which the mobile contact is at a distance from the fixed contact, and a closed state in which the mobile contact and the fixed contact meet to thereby establish an electrical connection, and in at least the first switch, the finger bearing the mobile contact is a conductor for electrically connecting the mobile contact to an electric circuit.

10. The switch device according to claim 9, wherein the first switch comprises an elastic element for returning the mobile contact into one of the open and closed states, the first side arm for pushing the finger of the first switch against the force of the elastic element.

11. The switch device according to claim 10, wherein the elastic element exerts a return force in a closing direction of the first switch, the first side arm being tiltable about said axis from an active retainining position in which the first switch is retained in the open state against the force of the elastic element in a direction towards an intermediate position in which the first switch is in the closed state, and to a passive position which is beyond the intermediate position in said direction in which passive position the elastic element generates a calibrated force for closing the first switch without interference of the first side arm.

12. The switch device according to claim 10, wherein, in the first switch, the elastic element is the finger for elastically returning said mobile contact.

13. The switch device according to claim 12, wherein, in the first switch, the finger is elongate and one end thereof is fixed, and is elastically flexible between the open and closed states of the mobile contact of the first switch, and wherein the mobile contact is at a distance from the fixed end of said finger.

14. The switch device according to claim 13, wherein the elongate finger has thin thickness between two opposite faces, with a mobile contact located on one of said faces.

15. The switch device according to claim 14, wherein the finger includes an elastically flexible elbow at the fixed end of the elongate finger.

16. The switch device according to claim 9, further comprising a crank rigidly connected to the shaft and bearing a crank pin at a radial distance from said axis.

* * * * *